US010418152B2

(12) United States Patent
Gundel

(10) Patent No.: US 10,418,152 B2
(45) Date of Patent: Sep. 17, 2019

(54) RIBBED HIGH DENSITY ELECTRICAL CABLE

(71) Applicant: 3M INNOVATIVE PROPERTIES COMPANY, St. Paul, MN (US)

(72) Inventor: Douglas B. Gundel, Cedar Park, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/707,039

(22) Filed: Sep. 18, 2017

(65) Prior Publication Data

US 2018/0005729 A1 Jan. 4, 2018

Related U.S. Application Data

(63) Continuation of application No. 14/438,900, filed as application No. PCT/US2013/064773 on Oct. 14, 2013, now Pat. No. 9,799,426.

(60) Provisional application No. 61/723,883, filed on Nov. 8, 2012.

(51) Int. Cl.

| | |
|---|---|
| ***H01B 11/04*** | (2006.01) |
| ***H01B 7/08*** | (2006.01) |
| ***H01B 11/00*** | (2006.01) |
| *H01B 11/20* | (2006.01) |

(52) U.S. Cl.

CPC ..... *H01B 7/0861* (2013.01); *H01B 11/002* (2013.01); *H01B 11/203* (2013.01)

(58) Field of Classification Search

CPC ..... H01B 11/04; H01B 7/08
USPC ..... 174/113 R, 117 F
See application file for complete search history.

(56) References Cited

U.S. PATENT DOCUMENTS

| | | | |
|---|---|---|---|
| 3,391,432 | A | 7/1968 | Durocher |
| 3,663,739 | A | 5/1972 | Chevrier |
| 3,775,552 | A | 11/1973 | Schumacher |
| 4,149,026 | A | 4/1979 | Fritz et al. |

(Continued)

FOREIGN PATENT DOCUMENTS

| | | |
|---|---|---|
| EP | 0 366 046 | 5/1990 |
| GB | 1 546 609 A | 5/1979 |

OTHER PUBLICATIONS

PCT International Search Report for PCT/US2013/064773, dated Jan. 27, 2014, 5 pages.

(Continued)

*Primary Examiner* — Chau N Nguyen
(74) *Attorney, Agent, or Firm* — Jonathan L. Tolstedt

(57) ABSTRACT

An electrical ribbon cable includes an insulated conductor extending along a longitudinal axis of the cable. The cable also includes a shielding film that carries the insulated conductor. The shielding film has a variable thickness defining a thickened rib portion and a thinned connecting portion, these portions being electrically conductive and extending along the longitudinal axis. The insulated conductor is disposed proximate the rib portion. The insulated conductor may be one of multiple insulated conductors that are organized into multiple conductor sets including at least a first and second conductor set, each conductor set including one or more of the insulated conductors, and the rib portion may be disposed between the first and second conductor sets.

6 Claims, 9 Drawing Sheets

(56) References Cited

U.S. PATENT DOCUMENTS

| | | | | |
|---|---|---|---|---|
| 4,185,162 | A * | 1/1980 | Bogese, II | H01B 7/0838 174/115 |
| 4,382,236 | A | 5/1983 | Suzuki | |
| 4,468,089 | A | 8/1984 | Brorein | |
| 4,481,379 | A | 11/1984 | Bolick et al. | |
| 4,780,157 | A | 10/1988 | Coon | |
| 5,250,127 | A | 10/1993 | Hara | |
| 5,360,944 | A * | 11/1994 | Springer | H01B 7/0838 174/102 R |
| 5,442,136 | A | 8/1995 | Allen | |
| 5,446,239 | A | 8/1995 | Mizutani et al. | |
| 6,043,434 | A | 3/2000 | Prudhon | |
| 6,268,566 | B1 | 7/2001 | Takiguchi et al. | |
| 6,448,497 | B1 | 9/2002 | McCracken et al. | |
| 6,717,058 | B2 | 4/2004 | Booth et al. | |
| 7,807,927 | B2 | 10/2010 | Yeh | |
| 9,263,172 | B2 | 2/2016 | Lotfi | |
| 2003/0213610 | A1 | 11/2003 | Ide et al. | |
| 2006/0016615 | A1 | 1/2006 | Schilson et al. | |
| 2007/0240898 | A1 | 10/2007 | Reichert et al. | |
| 2010/0071935 | A1 | 3/2010 | Wesselman et al. | |
| 2012/0048591 | A1 * | 3/2012 | Gareis | H01B 7/0823 174/102 R |
| 2012/0090866 | A1 | 4/2012 | Gundel | |
| 2012/0090872 | A1 | 4/2012 | Gundel | |
| 2012/0090873 | A1 | 4/2012 | Gundel | |
| 2012/0097421 | A1 | 4/2012 | Gundel | |

OTHER PUBLICATIONS

U.S. Appl. No. 61/378,856, "High Density Shielded Electrical Cable and Other Shielded Cables, Systems, and Methods", filed Aug. 31, 2010.

U.S. Appl. No. 61/378,902, "Electrical Characteristics of Shielded Electrical Cables", filed Aug. 31, 2010.

U.S. Appl. No. 61/378,877, "Connector Arrangements for Electrical Cables", filed Aug. 31, 2010.

U.S. Appl. No. 61/378,868, "Shielded Electrical Cable With Dielectric Spacing", filed Aug. 31, 2010.

U.S. Appl. No. 61/378,872, "Shielded Electrical Cable", filed Aug. 31, 2010.

U.S. Appl. No. 61/352,473, "Shielded Electrical Cable", filed Jun. 8, 2010.

U.S. Appl. No. 61/218,739, "Shielded Electrical Cable", filed Jun. 19, 2009.

De Araujo, D.N. et al. "Full-Wave, TwinAx, Differential Cable Modeling", IEEE, 2008 Electronic Components and Technology Conference, pp. 1684-1689.

* cited by examiner

RIBBED HIGH DENSITY ELECTRICAL CABLE

FIELD OF THE INVENTION

This invention relates generally to electrical ribbon cables suitable for data transmission and associated articles, systems, and methods, with particular application to ribbon cables that are shielded, can be mass-terminated, and provide high speed electrical properties.

BACKGROUND

Electrical cables for transmission of electrical signals are known. One common type of electrical cable is a coaxial cable. Coaxial cables generally include an electrically conductive wire surrounded by an insulator. The wire and insulator are surrounded by a shield, and the wire, insulator, and shield are surrounded by a jacket. Another common type of electrical cable is a shielded electrical cable comprising one or more insulated signal conductors surrounded by a shielding layer formed, for example, by a metal foil. To facilitate electrical connection of the shielding layer, a further un-insulated conductor is sometimes provided between the shielding layer and the insulation of the signal conductor or conductors. Both of these common types of electrical cable normally require the use of specifically designed connectors for termination, and are often not suitable for use with mass-termination techniques, i.e., the simultaneous connection of a plurality of conductors to individual contact elements, such as, e.g., electrical contacts of an electrical connector or contact elements on a printed circuit board. Although electrical cables have been developed to facilitate these mass-termination techniques, these cables often have limitations in the ability to mass-produce them, in the ability to prepare their termination ends, in their flexibility, and in their electrical performance. In view of the advancements in high speed electrical and electronic components, a continuing need exists for electrical cables that are capable of transmitting high speed signals, facilitate mass-termination techniques, are cost-effective, and can be used in a large number of applications.

BRIEF SUMMARY

We have developed electrical cables suitable for high speed data transmission that have unique and beneficial properties and characteristics, as well as systems utilizing such cables, and methods relating to such cables and systems. The cables are typically in a generally planar or ribbon format, with multiple channels or conductor sets extending along a length dimension of the cable and spaced apart from each other along a width dimension of the cable.

The cables may provide high packing density in a limited cable width, preferably while maintaining adequate high frequency electrical isolation and/or low crosstalk between different channels or conductor sets of the cable. The cables may provide an on-demand or localized drain wire feature. The cables may also provide multiple drain wires. The cables may also provide mixed conductor sets, e.g., one or more conductor sets adapted for high speed data transmission, and one or more conductor sets adapted for lower speed data transmission or power transmission. Some cables may provide only one of these beneficial design features, while others may provide combinations of some or all of these features.

The present application therefore discloses, inter alfa, electrical cables that include an insulated conductor extending along a longitudinal axis of the cable, and a first shielding film configured to carry the insulated conductor. The first shielding film has a variable thickness which defines a thickened rib portion and a thinned connecting portion, the rib portion and connecting portion being electrically conductive and extending along the longitudinal axis. The insulated conductor is disposed proximate the rib portion.

The cable may also include a second shielding film disposed opposite the first shielding film such that the insulated conductor is carried between the first and second shielding films. The second shielding film may be electrically conductive, and extend along the longitudinal axis.

The first shielding film may include a first polymeric base layer and a first metallization layer disposed on the first polymeric base layer. The first metallization layer may be present on the first polymeric base layer both at the rib portion and at the connecting portion. The second shielding film may include a second polymeric base layer and a second metallization layer disposed on the second polymeric base layer.

In a cross-sectional plane perpendicular to the longitudinal axis of the cable, the insulated conductor may have an outer dimension D and the rib portion may have a height H, and H may be at least 50% of D, or H may be at least 80% of D, or H may be equal to or greater than D.

If a second shielding film is present, it may have a substantially uniform thickness. The first shielding film may be in electrical contact with the second shielding film. At least the rib portion of the first shielding film, the connecting portion of the first shielding film, and a portion of the second shielding film may be in electrical contact with each other to form a closed conductive path to electrically shield the insulated conductor from at least one other insulated conductor in the cable.

The rib portion may have a substantially uniform height along the longitudinal axis. Alternatively, the rib portion may have a non-uniform height along the longitudinal axis. For example, the rib portion may be discontinuous along the longitudinal axis. Whether the rib portion has a uniform or non-uniform height, it may have a trapezoidal shape in a cross-sectional plane perpendicular to the longitudinal axis.

The insulated conductor may be one of a plurality of insulated conductors organized into a plurality of conductor sets including at least a first and second conductor set, and each conductor set may include one or more of the insulated conductors, and the rib portion may be disposed between the first and second conductor sets. The rib portion may help to provide electrical isolation between the first and second conductor sets. The rib portion may be a first rib portion in a plurality of thickened rib portions of the first shielding film, and the connecting portion may be a first connecting portion in a plurality of thinned connecting portions of the first shielding film, and the connecting portions may be arranged in alternating fashion with the rib portions. In a cross-sectional plane perpendicular to the longitudinal axis, the plurality of rib portions may have respective heights H, and the heights H of the rib portions may be substantially the same. Alternatively, in such a cross-sectional plane, the first rib portion may have a height H1, and a second rib portion may have a height H2, and H1 and H2 may differ by at least 10%.

The cable may also include a second shielding film disposed opposite the first shielding film such that the insulated conductors in the plurality of conductor sets are carried between the first and second shielding films, the second shielding film being electrically conductive and extending along the longitudinal axis. Each conductor set may be separated from a neighboring one of the conductor sets by one of the rib portions.

Also disclosed are electrical cables having a longitudinal axis, and including an insulated conductor, a first and second shielding film, and an electrically conductive rib member. The first shielding film may be configured to carry the insulated conductor, and may be electrically conductive and extending along the longitudinal axis. The second shielding film may be disposed opposite the first shielding film such that the insulated conductor is carried between the first and second shielding films, and the second shielding film may also be electrically conductive and extending along the longitudinal axis. The rib member may be disposed between the first and second shielding films proximate the insulated conductor.

Related methods, systems, and articles are also discussed.

These and other aspects of the present application will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

In the figures, like reference numerals designate like elements.

DETAILED DESCRIPTION OF ILLUSTRATIVE EMBODIMENTS

As the number and speed of interconnected devices increases, electrical cables that carry signals between such devices need to be smaller and capable of carrying higher speed signals without unacceptable interference or crosstalk. Shielding is used in some electrical cables to reduce interactions between signals carried by neighboring conductors. Many of the cables described herein have a generally flat configuration, and include conductor sets that extend along a length of the cable, as well as electrical shielding films disposed on opposite sides of the cable. At least one of the shielding films has a ribbed construction with rib portions and connecting portions, the rib portions being disposed between adjacent conductor sets to help electrically isolate the conductor sets from each other for reduced interference and crosstalk. The disclosed cables may also include drain wires that electrically connect to the shields, and extend along the length of the cable. The cable configurations described herein can help to simplify connections to the conductor sets and drain wires, reduce the size of the cable connection sites, and/or provide opportunities for mass termination of the cable.

Figure 1:
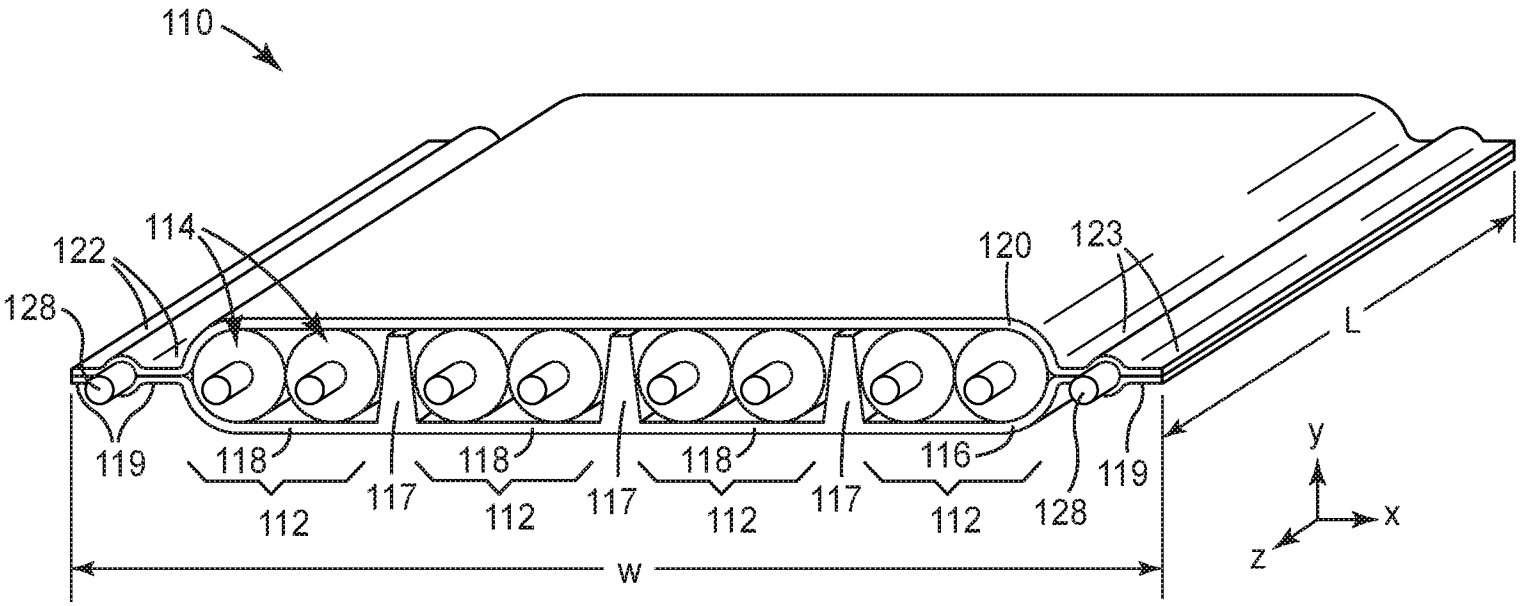
FIG. 1 is a perspective schematic view of an exemplary shielded electrical ribbon cable of ribbed design.

FIG. 1 illustrates an exemplary shielded electrical ribbon cable 110 having a ribbed construction. The cable 110 includes a plurality of conductor sets 112 spaced apart from each other along all or a portion of a width, w, of the cable 110, the conductor sets also each extending along a length, L, of the cable 110. The cable 110 may be arranged generally in a planar configuration as illustrated in FIG. 1, or it may be folded at one or more places along its length into a folded or bent configuration. If desired, some parts of the cable 110 may be arranged in a planar configuration and other parts of the cable may be folded. The flat cable can also be wound up or rolled up so that in transverse cross-section (see the x-y plane in FIG. 1) it has a generally round outer shape with a spiral inner configuration. In some cases, at least one of the conductor sets 112 of the cable 110 includes two insulated conductors 114 extending along the length L of the cable. The two insulated conductors 114 of the conductor sets 112 may be arranged substantially parallel to each other along all or a portion of the length L of the cable 110. The insulated conductors 114 may be or include insulated signal wires, insulated power wires, or insulated ground wires. A first shielding film 116 and a second shielding film 120 are disposed on opposite sides of the cable 110. These shielding films, individually and in combination, serve to carry the insulated conductors 114, such that the insulated conductors 114 remain confined within the cable, unless portion(s) of the first and/or second shielding film are removed or cut, e.g. at terminal ends of the cable 110 to allow one or more of the insulated conductors 114 to separate from the remaining insulated conductors.

In the figure, the length L extends generally parallel to the z-axis of a Cartesian coordinate system, such that the z-axis may be considered the longitudinal axis of the cable 110. The width w of the cable 110 extends generally parallel to the x-axis of the coordinate system.

In the embodiment of FIG. 1, the first shielding film 116 has a ribbed construction, such that the cable 110, of which the film 116 is a part, also has a ribbed construction. The ribbed construction of the film 116 is a consequence of the film 116 having a thickness that varies in such a way as to define rib portions and connecting portions. In cable 110, the variable thickness defines rib portions 117 and connecting portions 118, the rib portions being relatively thicker than the connecting portions, and the connecting portions being relatively thinner than the rib portions. The first shielding film 116 also has pinched portions 119, which mate with pinched portions 123 of second shielding film 120 to form pinched regions that extend along opposite edges of the cable 110, as shown. The rib portions 117, connecting portions 118, and pinched portions 119 are preferably integrally formed such that the first shielding film 116 is a continuous material layer across its width. For example, the film 116 may be formed by molding, stamping, embossing, and/or extruding a continuous film or material layer to define the thickened rib portions 117 and the thinned connecting portions 118, as well as the thinned pinched portions 119. The second shielding film 120 may also be or comprise a continuous film, of which the pinched portions 123 are a part.

At least the rib portions 117 and the connecting portions 118, or portions thereof, are electrically conductive such that, by themselves or in combination with other elements, they can electrically shield or isolate, at least in part, one conductor set 112 from a neighboring conductor set 112. This may be accomplished by fabricating the shielding film 116 from a thin metal foil or film, or from a polymer film which may be electrically insulating, but which may be provided with a thin metal coating or other electrically conductive material so that the rib portions 117 and connecting portions 118 are conductive. Such construction details are discussed further below. The second shielding film 120 is also preferably electrically conductive to provide additional isolation and shielding of the conductor sets. In this regard, the second shielding film 120 may make electrical contact (characterized by a low dc resistance relatively low DC resistance, e.g., a DC resistance of less than 10 ohms, or less than 2 ohms, or of substantially 0 ohms) with the rib portions 117 and/or other portions of the first shielding film 116, such that the films 116, 120 cooperate to further isolate or shield the conductor sets 112 from each other. Similar to the first shielding film 116, the second shielding film 120 may be composed entirely of a conductive material such as a metal, or it may comprise a base layer of an insulating polymer or other insulating material to which a metal coating or the like is applied to provide electrical conductivity.

A given rib portion 117, an adjacent connecting portion 118, and a portion of the second shielding film may be in electrical contact with each other to form a closed conductive path, or to surround, or at least partially surround, an insulated conductor 114 or conductor set 112 so that the conductor or conductor set is shielded from at least one other insulated conductor or conductor set in the cable. For example, electrically conductive portions of the shielding films 116, 120 may collectively encompass at least 75%, or at least 80, 85, or 90%, of the perimeter of any given conductor set 112. For conductor sets located at or near a central region of the cable 110, such a conductor set may be surrounded, at least in part, by the group of: one of the connecting portions 118; a corresponding opposed portion of the second shielding film 120; and two of the rib portions 117. For conductor sets located at the edges of the shielded ribbon cable, the group of surrounding elements may be the same, but in the embodiment of FIG. 1, one of the rib portions 117 is replaced with pinched portions 119, 123 of the first and second shielding films which form a pinched region of the cable 110. In the pinched regions of the cable 110, both of the shielding films 116, 120 are deflected towards the opposing shielding film to bring the pinched portions of the shielding films 116, 120 into closer proximity or direct contact. In alternative embodiments, one of the shielding films may remain relatively flat (not deflected) in the pinched region when the cable is in a planar or unfolded configuration, and the other shielding film on the opposite side of the cable may be deflected to bring the pinched portions of the shielding films into closer proximity or direct contact.

The cable 110 may also include one or more adhesive layers or materials, not shown in FIG. 1, in order to bond the shielding films 116, 120 to each other and/or to bond one or more of the insulated conductors 114 to one or both of the shielding films 116, 120. Such adhesives may be used to hold the various components of the cable 110 together.

In some cases, conductor sets 112 have a substantially curvilinearly-shaped envelope or perimeter in transverse cross-section, and the shielding films 116, 120 are disposed around conductor sets 112 such as to substantially conform to and maintain the cross-sectional shape along at least part of, and preferably along substantially all of, the length L of the cable 110. Maintaining the cross-sectional shape maintains the electrical characteristics of the conductor sets 112 along the length of the cable 110. This is an advantage over some conventional shielded electrical cables where disposing a conductive shield around a conductor set changes the cross-sectional shape of the conductor set.

Although in the embodiment of FIG. 1 each conductor set 112 has exactly two insulated conductors 114, in other embodiments, some or all of the conductor sets may include only one insulated conductor, or may include more than two insulated conductors 114. For example, an alternative shielded electrical cable similar in design to that of FIG. 1 may include two conductor sets each having four insulated conductors 114 (whereupon the first shielding film 116 may have only one rib portion 117, located between the two sets), or eight conductor sets each having only one insulated conductor 114 (whereupon the first shielding film 116 may have seven rib portions 117, one such rib portion being located between every two neighboring sets). This flexibility in the arrangement of conductor sets and insulated conductors allows the disclosed shielded electrical cables to be configured in ways that are suitable for a wide variety of intended applications. For example, the conductor sets and insulated conductors may be configured to form: a multiple twinaxial cable, i.e., multiple conductor sets each having two insulated conductors; a multiple coaxial cable, i.e., multiple conductor sets each having only one insulated conductor; or combinations thereof. In some embodiments, a given conductor set may further include a conductive shield disposed around the one or more insulated conductors, and an insulative jacket disposed around the conductive shield.

From the standpoint of packing density, it is often desirable to provide high packing density to maximize the number of insulated conductors and/or the number of conductor sets along the width dimension of the cable, or to minimize the width of the cable for a given number and size of insulated conductors and/or conductor sets. Such goals, if desired, can be achieved by designing the rib portions to be relatively narrow along the width dimension of the cable. In FIG. 1, this is shown by the rib portions 117 each having a width (a dimension along the x-axis) that is less than the width of the insulated conductors 114 that are adjacent the rib portion. In such a case, the two insulated conductors that are disposed adjacent to (and optionally in physical contact with) and on opposite sides of a given rib portion (such conductors thus belonging to different conductor sets) may have a center-to-center spacing that is less than the center-to-center spacing they would have if the rib portion were eliminated and replaced with a third insulated conductor having the same size as two original insulated conductors. It may therefore be advantageous in some cases to design the ribs to have a width dimension that is less than the width of an adjacent insulated conductor.

In addition to the conductor sets 112, the cable 110 of FIG. 1 is also shown to include optional ground conductors 128. The ground conductors 128 may be or include ground wires or drain wires. The ground conductors 128 can be spaced apart from, and extend in substantially the same direction as, the insulated conductors 114. As shown, the shielding films 116, 120 can be disposed around the ground conductors 128. An adhesive layer may be used to bond the pinched portions 119, 123 of the respective shielding films to each other in the pinched regions on both sides of ground conductors 128. The ground conductors 128 may electrically contact at least one of the shielding films 116, 120.

Figure 6:
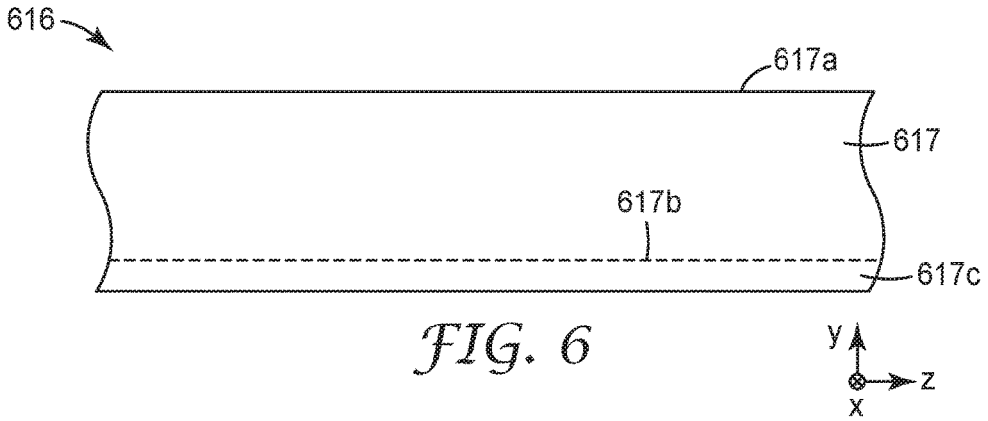
FIGS. 6 through 8 are side or lengthwise cross-sectional schematic views of portions of various ribbed shielding films that may be used in the disclosed electrical cables including that of FIG. 1.
Figure 7:
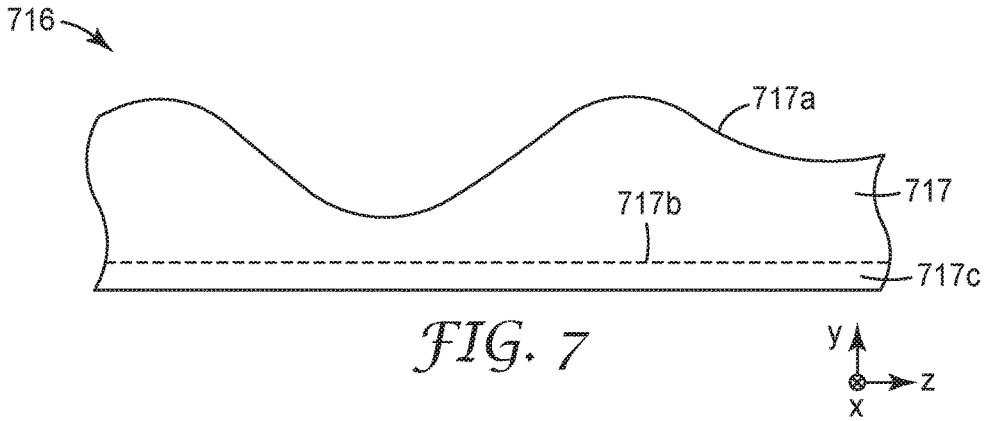
Figure 8:
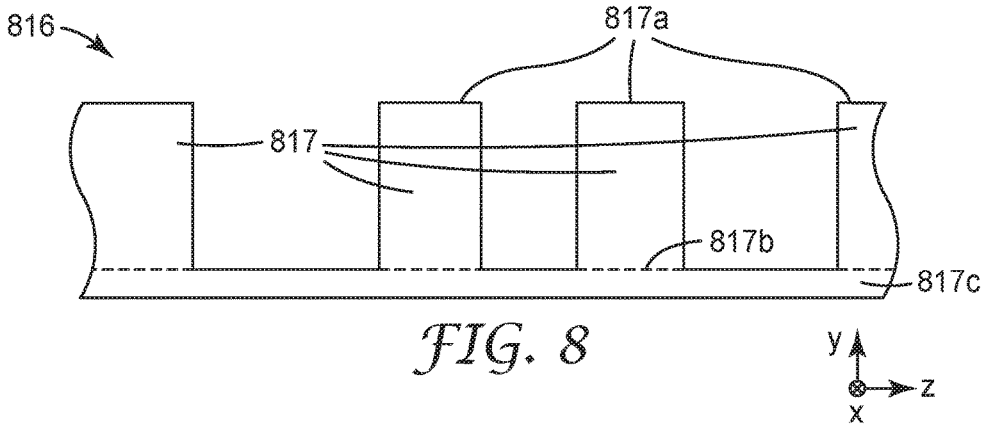

The ribbed features of the disclosed shielded ribbon cables can have a variety of shapes and configurations, both when viewed in transverse cross-section (see the x-y plane of FIG. 1) and when viewed in longitudinal cross-section (see the y-z plane of FIG. 1). FIGS. 2 through 5 illustrate some representative ribbed features in transverse cross-section, and FIGS. 6-8 illustrate some representative ribbed features in longitudinal cross-section.

FIGS. 2 through 5 show portions of representative first shielding films, any of which may be substituted for the first shielding film 116 of FIG. 1. The shielding films in FIGS. 2-5 are shown schematically, with little detail or embellishment, in order to draw attention to the shape and configuration of the rib portion of the shielding film. The reader will understand that for each illustrated film portion, the shielding film may in some cases have only a single material layer that is shaped as shown. In other cases, however, the shielding film may include other elements which are not shown in the schematic views, such as one or more electrically conductive layer or coating, and/or one or more adhesive layer. Although two rib portions are shown in each of the figures, the shielding film may have more than two, or less than two (i.e., one), such rib features depending on the number of conductor sets that are desired for the shielded ribbon cable. If two or more rib portions are included, the spacing between any two adjacent rib portions of the shielding film may be tailored to minimize the width of the cable, e.g., so that the desired number of insulated conductors of the conductor set can be laid down side-by-side, with the conductor on one side of the conductor set being adjacent to (and in some cases in contact with) one rib portion, and the conductor on the other side of the conductor set being adjacent to (and in some cases in contact with) the other rib portion. For a conductor set having only one insulated conductor, the spacing between the rib portions can be such that the insulated conductor is adjacent to (e.g. in contact with) one rib portion on one side of the insulated conductor, and is adjacent to (e.g. in contact with) the other rib portion on the other side of the insulated conductor.

Figure 2:
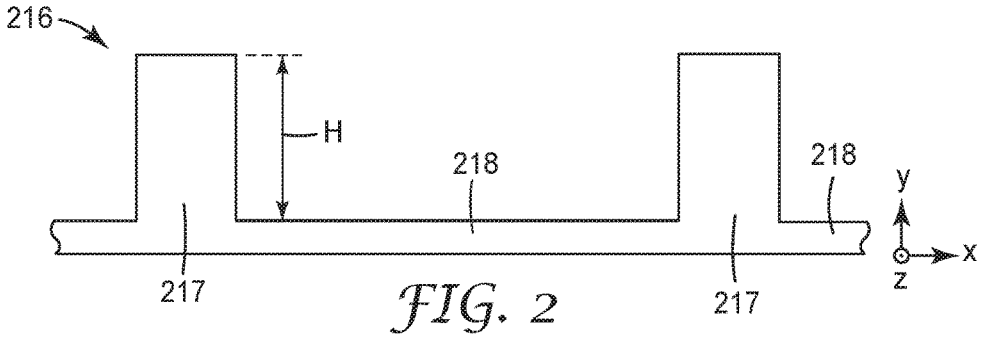
FIGS. 2 through 5 are front cross-sectional schematic views of portions of various ribbed shielding films that may be used in the disclosed electrical cables including that of FIG. 1.

Turning then to FIG. 2, we see there a first shielding film 216 having rib portions 217 and connecting portions 218. The film 216 is shown in the context of a Cartesian coordinate system consistent with that of FIG. 1. The rib portions 217 have a generally rectangular shape, and a height H in relation to the connecting portions 218. One or more insulated conductors of a conductor set may be placed between the rib portions 217, and a second shielding film may be added as in FIG. 1, to provide a shielded ribbon cable.

Figure 3:
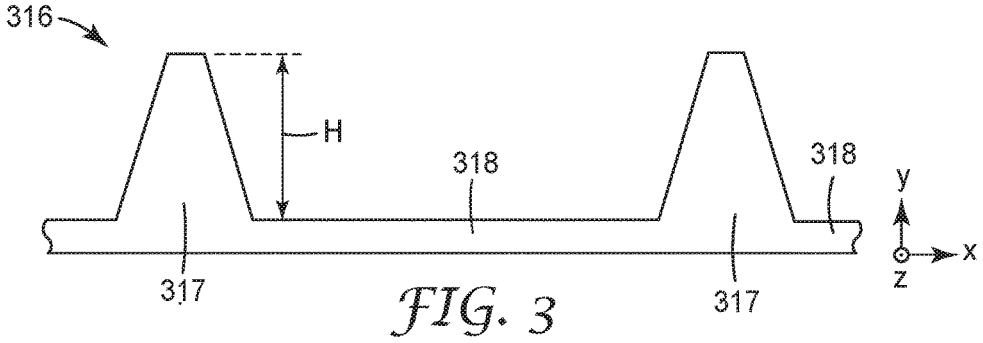

In FIG. 3, a first shielding film 316 has rib portions 317 and connecting portions 318. The film 316 is shown in the context of a Cartesian coordinate system consistent with that of FIG. 1. The rib portions 317 have a generally trapezoidal (or truncated triangular) shape, and a height H in relation to the connecting portions 318. One or more insulated conductors of a conductor set may be placed between the rib portions 317, and a second shielding film may be added as in FIG. 1, to provide a shielded ribbon cable.

Figure 4:
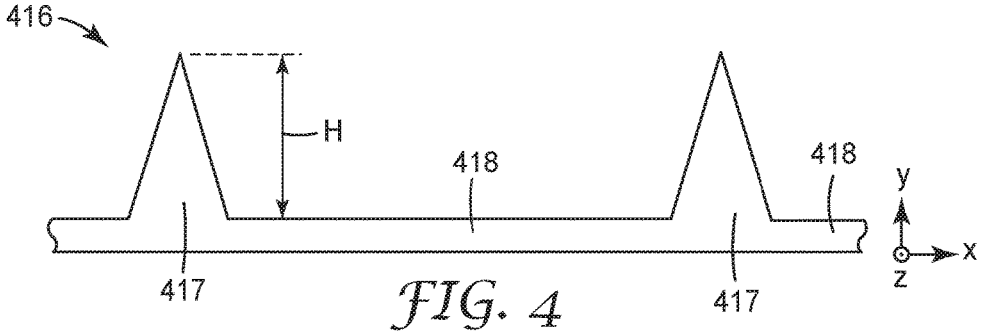

In FIG. 4, a first shielding film 416 has rib portions 417 and connecting portions 418. The film 416 is shown in the context of a Cartesian coordinate system consistent with that of FIG. 1. The rib portions 417 have a generally triangular shape, and a height H in relation to the connecting portions 418. One or more insulated conductors of a conductor set may be placed between the rib portions 417, and a second shielding film may be added as in FIG. 1, to provide a shielded ribbon cable.

Figure 5:
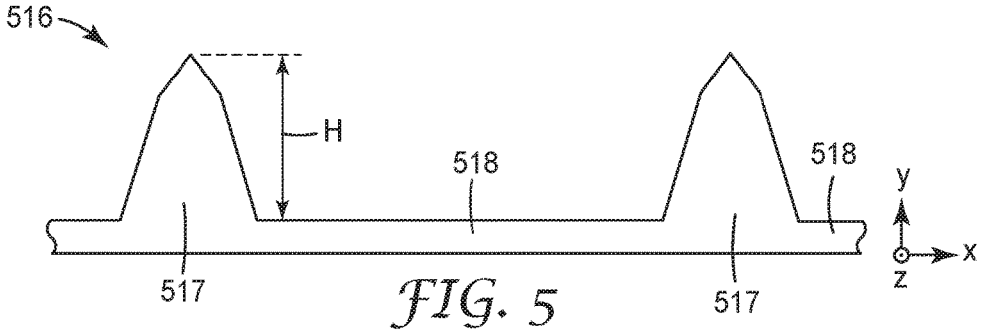

In FIG. 5, a first shielding film 516 has rib portions 517 and connecting portions 518. The film 516 is shown in the context of a Cartesian coordinate system consistent with that of FIG. 1. The rib portions 517 have a generally pentagonal shape, and a height H in relation to the connecting portions 518. One or more insulated conductors of a conductor set may be placed between the rib portions 517, and a second shielding film may be added as in FIG. 1, to provide a shielded ribbon cable.

In the embodiments of FIGS. 2-5, the illustrated rib portions of a given film are shown to have a uniform shape and height. In general, two, or some, or all rib portions of a given shielding film may have the substantially the same shape and dimensions (e.g. height and width), e.g., the shape and dimensions may be the same to within manufacturing tolerances. However, in some cases at least two rib portions may have substantially different shapes and/or dimensions. For example, a conductor set may be bounded on one side with a rectangular rib portion of a shielding film, and on the other side with a triangular or trapezoidal rib portion of the shielding film. Whether or not differently shaped rib portions are used, the rib portions may have substantially different heights and/or widths, as discussed further below.

FIGS. 6 through 8 show how any given rib portion may appear in longitudinal cross-sectional view. Thus, in FIG. 6 a first shielding film 616 is shown in the context of a Cartesian coordinate system consistent with that of FIG. 1. The shielding film 616 has a rib portion 617, which rib portion may be the same as or similar to any of the rib portions discussed in connection with FIGS. 1-5. The height of the rib portion 617 may be characterized by the distance, measured parallel to the thickness direction (the y-axis in FIG. 6), between an upper boundary 617*a* and a lower boundary 617*b* of the rib portion. (The terms "upper" and "lower" are used here with regard to the orientation shown in FIG. 6, but should not be construed in a limiting fashion, since the film 616 may be oriented in any desired fashion relative to gravity.) The lower boundary 617*b* may correspond to a surface of a connecting portion which may join the rib portion 617 to other rib portions, the connecting portion corresponding to a land layer 617*c* of the rib portion 617. The rib portion 617 of FIG. 6 demonstrates the simple case in which the rib portion has a constant height along its length. That is, the distance between upper boundary 617*a* and lower boundary 617*b*, measured parallel to the thickness direction, yields a height H that is substantially the same regardless of where along the length of the rib portion (i.e. regardless of position along the z-axis) it is measured.

In FIG. 7, a first shielding film 716 has a rib portion 717, and is shown in the context of a Cartesian coordinate system consistent with that of FIG. 1. The rib portion 717 may be the same as or similar to any of the rib portions discussed in connection with FIGS. 1-5. Just as in FIG. 6, the height of the rib portion 717 may be measured as the distance along the thickness direction between an upper boundary 717*a* and a lower boundary 717*b* of the rib portion, the lower boundary 717*b* corresponding to a surface of a connecting portion associated with a land layer 717*c* of the rib portion. But unlike FIG. 6, the height of the rib portion 717 changes substantially along its length. That is, the distance between upper boundary 717*a* and lower boundary 717*b*, measured parallel to the thickness direction, yields a height that changes as a function of where along the length of the rib portion (i.e., as a function of position along the z-axis) it is measured. As a function of position along the z-axis, the height is shown in FIG. 7 to be smoothly varying. In general, the functional relationship of height versus longitudinal position may be smoothly varying, e.g. it may have a continuous first derivative, or its variation may be non-smooth, e.g. it may have a discontinuous first derivative. Further, the functional relationship of height versus longitudinal position may be periodic, non-periodic, or combinations thereof, e.g., periodic in some places and non-periodic in other places, for example. Unless otherwise specified, "the height H" of a rib portion having a variable height, such as that of FIG. 7, may be construed to mean the maximum height, or, in some cases, the average height of the rib portion.

FIG. 8 shows a first shielding film 816 having a rib portion 817 in the context of a Cartesian coordinate system consistent with that of FIG. 1. The rib portion 817 may be the same as or similar to any of the rib portions discussed in connection with FIGS. 1-5. Just as in FIGS. 6 and 7, the height of the rib portion 817 may be measured as the distance along the thickness direction between an upper boundary 817*a* and a lower boundary 817*b* of the rib portion, the lower boundary 817*b* corresponding to a surface of a connecting portion associated with a land layer 817*c* of the rib portion. Rib portion 817 is similar to that of FIG. 7 in that its height changes substantially along its length. But unlike FIG. 7, the height of the rib portion 817 changes discontinuously, or, in a non-smooth fashion, as a function of position along the length of the rib portion, and furthermore, in some places the height of the rib portion is substantially zero. Unless otherwise specified, the "height H" of a rib portion such as that of FIG. 8 may be construed to mean the maximum height, or, in some cases, the average height of the rib portion.

We have thus seen in connection with FIGS. 6-8 that any given rib portion of a shielding film in the disclosed shielded ribbon cables can have a height that is uniform along its length, or a height that changes along its length in various ways, e.g., continuously or discontinuously. The use of ribs that maintain a uniform height along their length is desirable in many applications because such ribs can help to ensure that the impedance, and/or other electrical characteristic, of the conductor sets is maintained at a constant value along the length of the cable with little or no variation, which in turn may provide superior signal integrity for the shielded cable. Any impedance changes along the length of a transmission line (conductor set) may cause power to be reflected back to the source instead of being transmitted to the target. Therefore in some cases it is desirable for the transmission line to have no impedance variation along its length, or, depending on the intended application, variations up to 5-10% may be acceptable. Another electrical characteristic that is often considered in twinaxial cables (differentially driven) is skew or unequal transmission speeds of two transmission lines of a pair along at least a portion of their length. Skew produces conversion of the differential signal to a common mode signal that can be reflected back to the source, reduces the transmitted signal strength, creates electromagnetic radiation, and can dramatically increase the bit error rate, in particular jitter. Ideally, a pair of transmission lines will have no skew, but, depending on the intended application, a differential S-parameter SCD21 or SCD12 value (representing the differential-to common mode conversion from one end of the transmission line to the other) of less than −25 to −30 dB up to a frequency of interest, such as, e.g., 6 GHz, may be acceptable. Alternatively, skew can be measured in the time domain and compared to a required specification. Depending on the intended application, values of less than about 20 picoseconds/meter (ps/m) and preferably less than about 10 ps/m may be acceptable.

We will now discuss, in connection with FIGS. 9 through 19, some additional design variations that impact the appearance of the shielded ribbon cable in transverse cross section. In these figures, the cables are depicted schematically, with few details of the constituent components of the cable being shown. For example, the cables may include additional layers and coatings, such as adhesive layer(s) and/or conductive coating(s), on one or both of the shielding films, but such layers and coatings are omitted from the figures for simplicity. However, as discussed above, at least the rib portions and the connecting portions of the first shielding film, or portions thereof, are preferably electrically conductive such that, by themselves or in combination with other elements, they can electrically shield or isolate, at least in part, one conductor set from other conductor sets in the cable. The second shielding film is also preferably electrically conductive to provide additional isolation and shielding of the conductor sets. At least the rib portion of the first shielding film, the connecting portion of the first shielding film, and a portion of the second shielding film may be in electrical contact with each other to form a closed conductive path to electrically shield the insulated conductor from at least one other insulated conductor in the cable.

In some cases, it is desirable for the height H of the rib portion of the first shielding film to be at least 50% of D, or at least 80% of D, or H may be equal to or greater than D, where D refers to the outer dimension (e.g. diameter) of the insulated conductor. If a second shielding film is present, it may have a substantially uniform thickness, or it may have a ribbed configuration having the same or similar spacing as the rib portions of the first shielding film. The rib portion of the first shielding film may be one of a plurality of rib portions of the first shielding film, and the connecting portion of the first shielding film may be one of a plurality of connecting portions of the first shielding film, and the connecting portions may be arranged in alternating fashion with the rib portions. In transverse cross-section, the plurality of rib portions may have respective heights H which are all substantially the same, or some heights H may differ from others. For example, a first rib portion may have a height H1, and a second rib portion may have a height H2, and H1 and H2 may differ by at least 10%.

Figure 9:
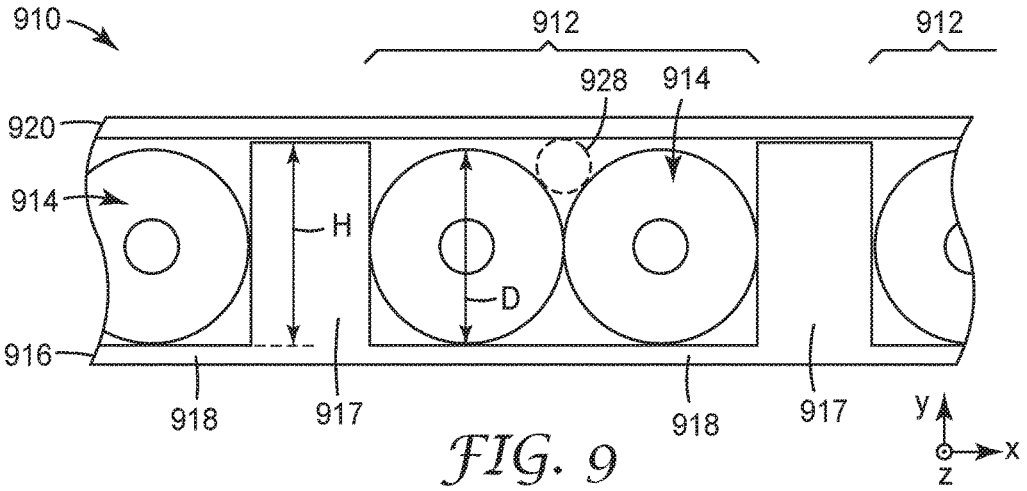
FIGS. 9 through 19 are front cross-sectional schematic views of portions of more exemplary ribbed electrical ribbon cables.

Turning then to FIG. 9, we see there a portion of a shielded electrical ribbon cable 910 having a ribbed construction. For reference purposes, FIG. 9, as well as FIGS. 10-19, include a Cartesian coordinate system that is consistent with that of FIG. 1. In that regard, any of the features discussed in connection with cable 110 of FIG. 1 can also be incorporated into the cable 910. Thus, the cable 910 includes insulated conductors 914 arranged into a plurality of conductor sets 912, the conductor sets 912 being spaced apart from each other along all or a portion of a width (x-direction) of the cable 910, the conductor sets (and their respective individual insulated conductors) also each extending along a length (z-direction) of the cable 910. As shown, at least one of the conductor sets 912 may include two insulated conductors 914, but other numbers of insulated conductors can also be used for any or all of the conductor sets 912.

A first shielding film 916 and a second shielding film 920 are disposed on opposite sides of the cable 910. These shielding films, individually and in combination, serve to carry the insulated conductors 914 such that the insulated conductors 914 remain confined within the cable. The first shielding film 916 has a variable thickness which defines thick rib portions 917 and thin connecting portions 918. The rib portions and connecting portions alternate along the width of the shielding film 916, with a spacing tailored so that the conductor sets 912 can fit between consecutive rib portions 917, with one insulated conductor 914 of a given conductor set disposed proximate one rib portion 917 and, optionally, another insulated conductor of such conductor set disposed proximate a different rib portion 917. A given insulated conductor 914 may be in physical contact with the rib portion 917 it is adjacent to. To promote high packing density, the rib portions are preferably designed to be relatively narrow along the width dimension (x-direction) of the cable, as discussed elsewhere herein. The second shielding film 920 has a substantially uniform thickness.

Electrically conductive portions of the first and second shielding films, including rib portions of the first shielding film, may form a closed conductive path, or may surround, or at least partially surround, each conductor set 912 so that the conductor sets within the cable are effectively electrically shielded from each other, with respect to electrical signal crosstalk and interference. Electrically conductive portions of the shielding films 916, 920 may for example collectively encompass at least 75%, or at least 80, 85, or 90%, or even 95% or 100%, of the perimeter of any given conductor set 912.

The cable 910 may also include one or more ground conductors, such as optional ground conductor 928. Typically, the ground conductor 928 extends along the length of the cable similar to insulated conductors 914. The ground conductor may make electrical contact (characterized by a low DC resistance) with either or both of the first and second shielding films. A given ground conductor may be grouped together with one of the conductor sets 912 as shown, or it may be separated or isolated from the conductor sets, as shown in FIG. 1.

For simplicity and generality, the rib portions are shown in FIG. 9 (and in other figures including FIGS. 10-19) to have a generally rectangular profile in transverse cross section, but the reader will understand that any other suitable profile shape may be used as discussed elsewhere herein. The rib portions 917 have heights H which are substantially the same. As shown, the height H is about the same as D but slightly larger than D, where D is the outer dimension (diameter) of the insulated conductors 914. For example, H may be greater than D but less than 1.1*D. In this case, conveniently, the second shielding film 920 may remain substantially flat and still make physical and/or electrical contact with the tops of the rib portions 917 to provide a closed or substantially closed cavity within which the insulated conductors 914 of each conductor set 912 may reside.

Figure 10:
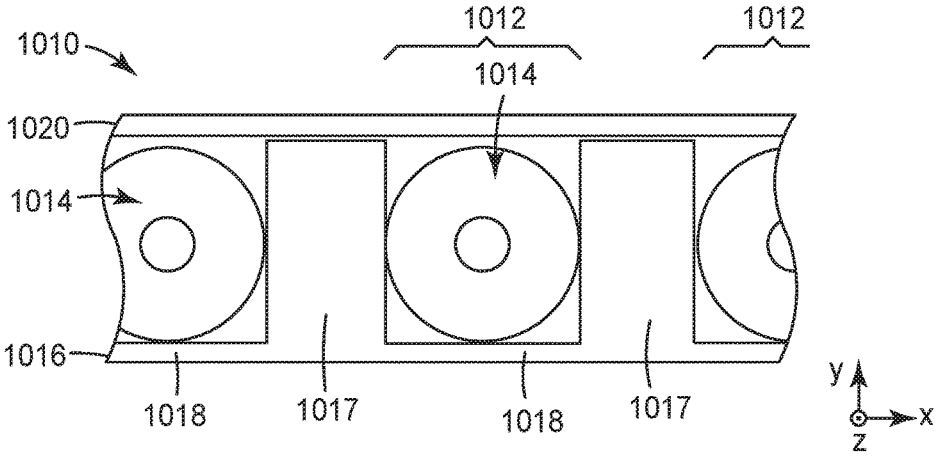

In FIG. 10, we see a portion of another shielded electrical ribbon cable 1010. As shown, the cable 1010 has at least one conductor set 1012 that contains only one insulated conductor 1014. In other respects, the cable 1010 may be the same as or similar to that of FIG. 9. Thus, cable 1010 has a ribbed construction. A first shielding film 1016 and a second shielding film 1020, which individually and in combination carry the insulated conductors 1014, are disposed on opposite sides of the cable 1010. The first shielding film 1016 has a variable thickness which defines thick rib portions 1017 and thin connecting portions 1018. The second shielding film 1020 has a substantially uniform thickness. Electrically conductive portions of the first and second shielding films, including rib portions of the first shielding film, may form a closed conductive path, or may surround, or at least partially surround, each conductor set 1012 so that the conductor sets within the cable are effectively electrically shielded from each other. The cable 1010 may also include one or more ground conductors, not shown in FIG. 10. The rib portions 1017 have heights H which are substantially the same. The height H may be about the same as D but slightly larger than D, as discussed in connection with FIG. 9.

Figure 11:
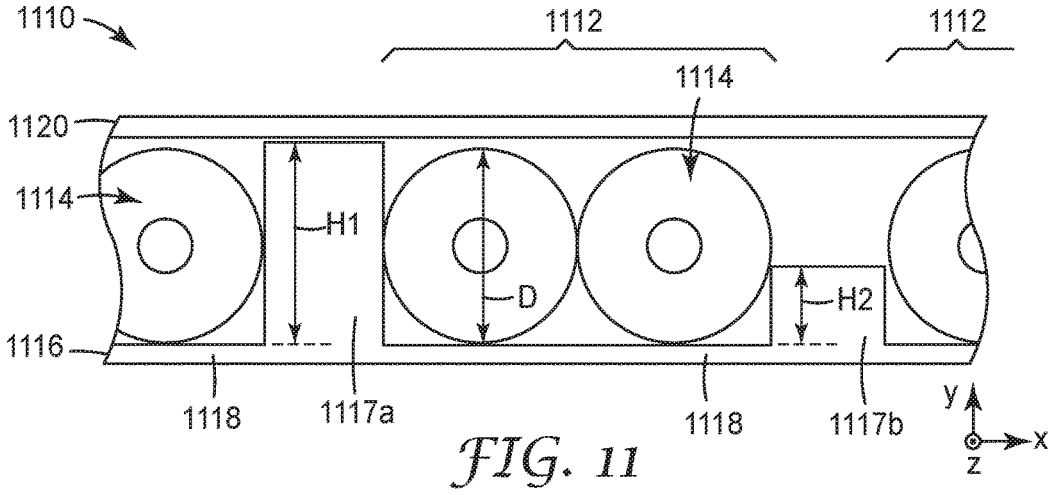

FIG. 11 shows a portion of another shielded electrical ribbon cable 1110 having a ribbed construction. The cable 1110 may be the same as or similar to cable 910 of FIG. 9, except that at least two of the ribbed features of cable 1110 have substantially different heights. Thus, the cable 1110 includes on opposite sides thereof a first shielding film 1116 and a second shielding film 1120, which individually and in combination carry insulated conductors 1114, the insulated conductors being organized into conductor sets 1112. The first shielding film 1116 has a variable thickness which defines thick rib portions 1117*a*, 1117*b* (collectively referred to as rib portions 1117) and thin connecting portions 1118. The second shielding film 1120 has a substantially uniform thickness. Electrically conductive portions of the first and second shielding films, including rib portions of the first shielding film, may form a closed conductive path, or may surround, or at least partially surround, each conductor set 1112 so that the conductor sets within the cable are effectively electrically shielded from each other. The cable 1110 may also include one or more ground conductors, not shown in FIG. 11. At least some of the rib portions 1117 have substantially different rib heights H. For example, the height H1 of rib portion 1117*a* may be roughly equal to the insulated conductor outer dimension D, e.g., H1 may be in a range from 0.9*D to 1.1*D, and H2 may be roughly equal to about half of the dimension D, e.g., H2 may be in a range from 0.4*D to 0.6*D. The reader will understand that this combination of H1 and H2 is merely exemplary, and other heights and ratios of heights can also be used.

In some applications, an electrically conductive envelope or shell that lacks symmetry with respect to a central point or bisecting plane of the conductor set, such as may be provided by the rib portions 1117*a*, 1117*b* in conjunction with other electrically conductive portions of the films 1116, 1120, may be considered disadvantageous relative to a conductive envelope or shell that possesses such symmetry, such as may be provided in the cables of FIGS. 9 and 10. Stated differently, in some applications an electrically conductive envelope or shell that possesses symmetry with respect to a central point or bisecting plane of the conductor set, such as may be provided in the cables of FIGS. 9 and 10, may be considered advantageous relative to a conductive envelope or shell that does not possesses such symmetry, such as may be provided in the cable of FIG. 11. This is because if substantial electrical symmetry between two conducting wires is not achieved, unequal propagation rates and therefore skew can result. In general, a physical symmetry between the two wires in the pair can help ensure electrical symmetry and therefore better signal integrity characteristics. A general rule is that with mixed dielectrics surrounding the conductors (for example air plus polymer structures for example), each wire of the pair should be surrounded by the same structures at the same distance. i.e. symmetry.

Figure 12:
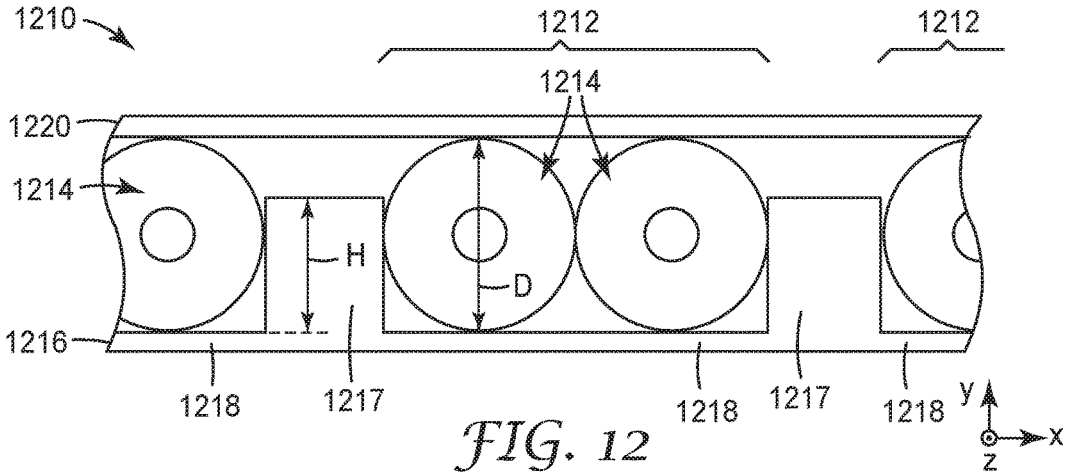

FIG. 12 shows a portion of another shielded electrical ribbon cable 1210 having a ribbed construction. The cable 1210 may be the same as or similar to cable 910 of FIG. 9, except that the ribbed features of cable 1210 are substantially shorter such that gaps are created between the tops of the rib portions and the upper shielding film. Thus, the cable 1210 includes on opposite sides thereof a first shielding film 1216 and a second shielding film 1220, which individually and in combination carry insulated conductors 1214, the insulated conductors being organized into conductor sets 1212. The first shielding film 1216 has a variable thickness which defines thick rib portions 1217 and thin connecting portions 1218. The second shielding film 1220 has a substantially uniform thickness. Electrically conductive portions of the first and second shielding films, including rib portions of the first shielding film, may form a conductive path that partially surrounds each conductor set 1212 so that the conductor sets within the cable are effectively electrically shielded from each other. The cable 1210 may also include one or more ground conductors, not shown in FIG. 12. The rib portions 1217 have rib heights H which are substantially the same, and which are substantially less than the insulated conductor outer dimension D. For example, the height H may be about half of D, e.g., in a range from 0.4*D to 0.6*D. The reduced rib height produces a conductive gap (i.e., an absence of electrically conductive material) between the tops of the rib portions 1217 and the second shielding film 1220. In spite of the gaps, the first and second shielding films 1216, 1220 may provide enough conductive shielding around the conductor sets 1212 to provide adequate electrical isolation between such sets.

Figure 13:
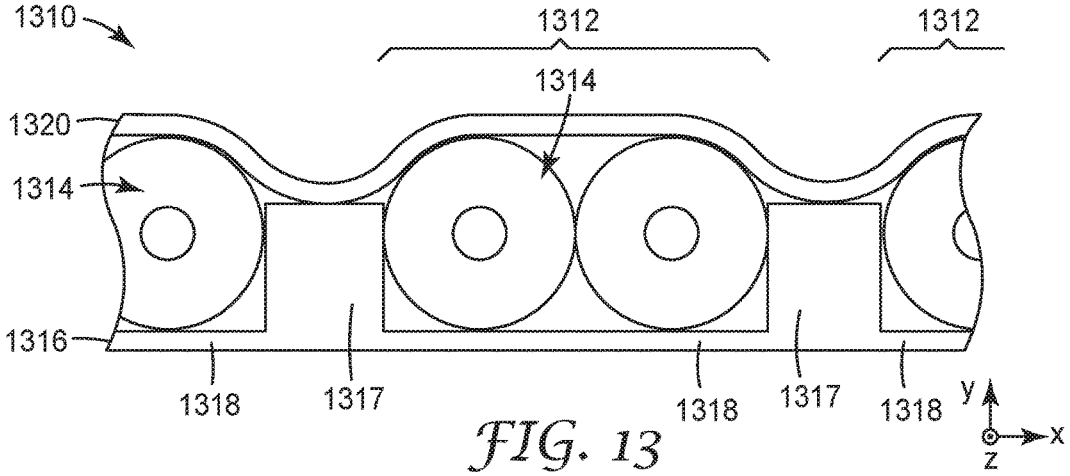

FIG. 13 shows a portion of another shielded electrical ribbon cable 1310 having a ribbed construction. The cable 1310 may be the same as or similar to cable 1210 of FIG. 12, except that the second shielding film is shaped or deflected (rather than being flat) in such a way as to reduce or eliminate the conductive gaps discussed in connection with FIG. 12. Thus, the cable 1310 includes on opposite sides thereof a first shielding film 1316 and a second shielding film 1320, which individually and in combination carry insulated conductors 1314, the insulated conductors being organized into conductor sets 1312. The first shielding film 1316 has a variable thickness which defines thick rib portions 1317 and thin connecting portions 1318. The second shielding film 1320 has a substantially uniform thickness, but is not substantially flat. Electrically conductive portions of the first and second shielding films, including rib portions of the first shielding film, may form a closed conductive path, or may surround, or at least partially surround, each conductor set 1312 so that the conductor sets within the cable are effectively electrically shielded from each other. The cable 1310 may also include one or more ground conductors, not shown in FIG. 13. The rib portions 1317 have rib heights H which are substantially the same, and which are substantially less than the insulated conductor outer dimension D. For example, the height H may be about half of D. But rather than producing a conductive gap, as in FIG. 12, little or no conductive gap is produced in the cable 1310 as a result of the second shielding film, which is preferably flexible and/or conformable, being shaped or deflected so as to make electrical and/or physical contact with the tops of the rib portions 1317.

Figure 14:
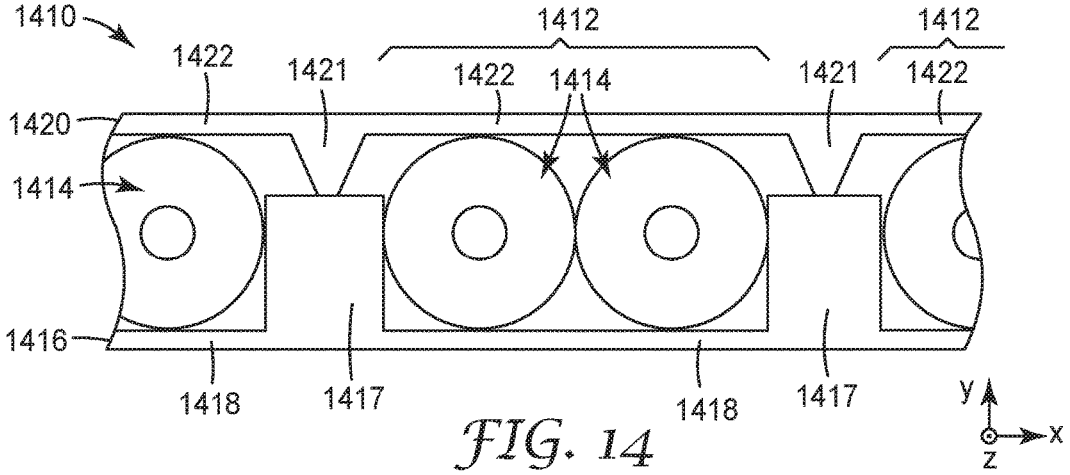

FIG. 14 shows a portion of still another shielded electrical ribbon cable 1410 having a ribbed construction. The cable 1410 may be the same as or similar to cable 1310 of FIG. 13, except that the second shielding film makes physical and/or electrical contact with the tops of the rib portions as a result of having a variable thickness of its own, which defines rib portions and connecting portions in the second shielding film. Thus, both the first shielding film and the second shielding film have variable thicknesses which define rib portions and connecting portions. The cable 1410 therefore includes on opposite sides thereof a first shielding film 1416 and a second shielding film 1420, which individually and in combination carry insulated conductors 1414, the insulated conductors being organized into conductor sets 1412. The first shielding film 1416 has a variable thickness which defines thick rib portions 1417 and thin connecting portions 1418. The second shielding film 1420 likewise has a variable thickness which defines thick rib portions 1421 and thin connecting portions 1422. Note that the rib portions 1421 need not in general have (but may have) the same height and/or shape as the rib portions 1417; however, the rib portions 1421 preferably have a spacing that substantially matches the spacing of the rib portions 1417 so that rib portions between the two shielding films can be aligned with one another, and make electrical and/or physical contact, across the entire width of the cable 1410 at the same time. Electrically conductive portions of the first and second shielding films, including rib portions of the first shielding film and rib portions of the second shielding film, may form a closed conductive path, or may surround, or at least partially surround, each conductor set 1412 so that the conductor sets within the cable are effectively electrically shielded from each other. The cable 1410 may also include one or more ground conductors, not shown in FIG. 14. The rib portions 1417 have rib heights H which are substantially the same, and which are substantially less than the insulated conductor outer dimension D. For example, the height H may be about half of D. The rib portions 1421 also have rib heights H' which are substantially the same, and which are substantially less than D. Little or no conductive gap is produced in the cable 1410 as a result of the contact or substantial contact between rib portions 1417 of the first shielding film and rib portions 1421 of the second shielding film.

Figure 15:
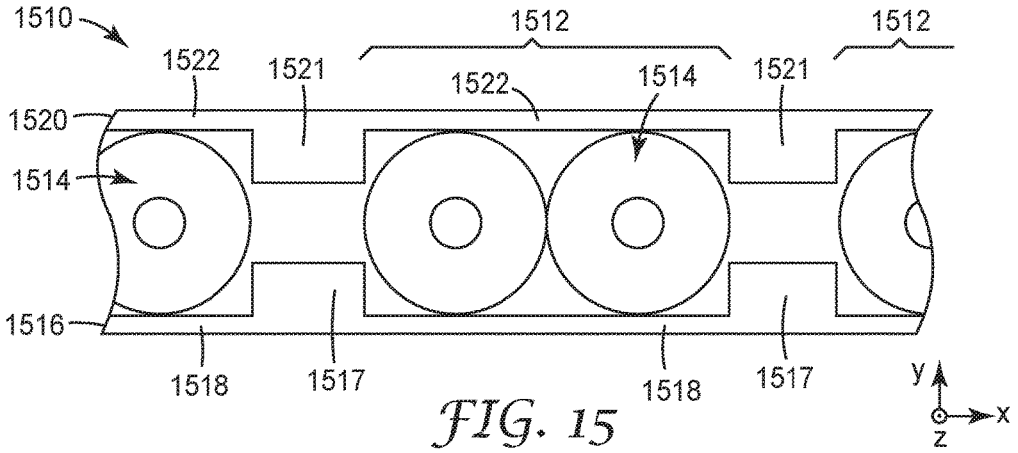

FIG. 15 shows a portion of another shielded electrical ribbon cable 1510 having a ribbed construction. The cable 1510 may be the same as or similar to cable 1410 of FIG. 14, e.g., both the first and second shielding films have variable thicknesses which define respective rib portions and connecting portions, however, the rib portions of the first and/or second shielding films are substantially shorter than in FIG. 14 such that conductive gaps are created between the tops of the respective rib portions. The cable 1510 thus includes on opposite sides thereof a first shielding film 1516 and a second shielding film 1520, which individually and in combination carry insulated conductors 1514, the insulated conductors being organized into conductor sets 1512. The first shielding film 1516 has a variable thickness which defines thick rib portions 1517 and thin connecting portions 1518. The second shielding film 1520 likewise has a variable thickness which defines thick rib portions 1521 and thin connecting portions 1522. The rib portions 1521 need not in general have (but may have) the same height and/or shape as the rib portions 1517; however, the rib portions 1521 preferably have a spacing that substantially matches the spacing of the rib portions 1517 so that rib portions between the two shielding films can be aligned with one another across the entire width of the cable 1510 at the same time. Electrically conductive portions of the first and second shielding films, including rib portions of the first shielding film and rib portions of the second shielding film, may partially surround each conductor set 1512 so that the conductor sets within the cable are effectively electrically shielded from each other. The cable 1510 may also include one or more ground conductors, not shown in FIG. 15. The rib portions 1517 have rib heights H which are substantially the same, and which are substantially less than the insulated conductor outer dimension D. For example, the height H may be about one-half to one-fourth of D. The rib portions 1521 also have rib heights H' which are substantially the same, and which are substantially less than D, e.g., about one-half to one-fourth of D. The reduced rib heights produce conductive gaps between the tops of the rib portions 1517 and the tops of the rib portions 1521. In spite of the gaps, the first and second shielding films 1516, 1520 may provide enough conductive shielding around the conductor sets 1512 to provide adequate electrical isolation between such sets.

Figure 16:
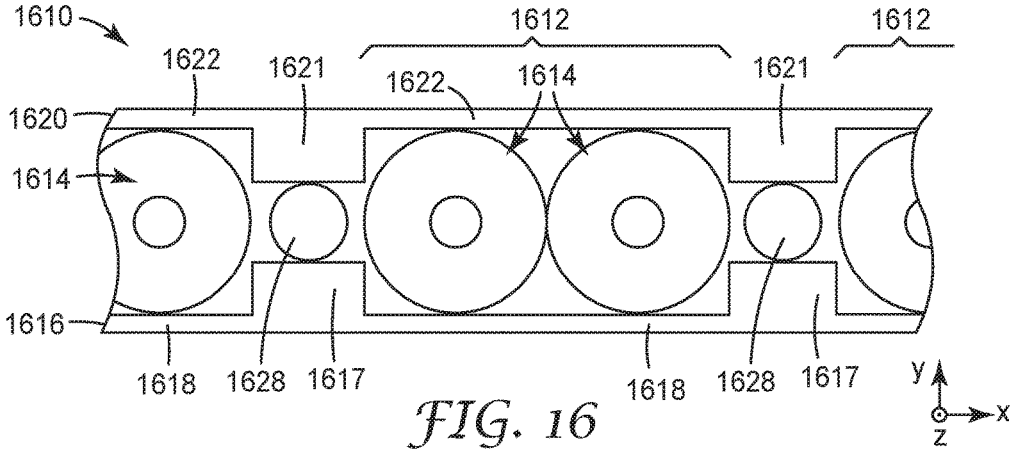

FIG. 16 shows a portion of another shielded electrical ribbon cable 1610 having a ribbed construction. The cable 1610 may be the same as or similar to cable 1510 of FIG. 15, except that additional conductive members can be placed between the rib portions to reduce or eliminate the conductive gaps created between the tops of the respective rib portions. The cable 1610 thus includes on opposite sides thereof a first shielding film 1616 and a second shielding film 1620, which individually and in combination carry insulated conductors 1614, the insulated conductors being organized into conductor sets 1612. The first shielding film 1616 has a variable thickness which defines thick rib portions 1617 and thin connecting portions 1618. The second shielding film 1620 likewise has a variable thickness which defines thick rib portions 1621 and thin connecting portions 1622. The rib portions 1621 need not in general have (but may have) the same height and/or shape as the rib portions 1617; however, the rib portions 1621 preferably have a spacing that substantially matches the spacing of the rib portions 1617 so that rib portions between the two shielding films can be aligned with one another across the entire width of the cable 1610 at the same time. Electrically conductive portions of the first and second shielding films, including rib portions of the first shielding film and rib portions of the second shielding film, may partially surround each conductor set 1612 due to the presence of gaps between the tops of the rib portions 1617, 1621. However, in cable 1610, additional conductive members 1628 are disposed within the gaps to partially or entirely eliminate the conductive gaps and provide a conductive path that is closed, or that surrounds or at least partially surrounds, each conductor set 1612 so that the conductor sets within the cable are effectively electrically shielded from each other. One, some, or all of the additional conductive members 1628 may be ground conductors, or they may be non-insulated wires other than ground conductors, for example. Whether or not any of the additional conductive members 1628 are ground conductors, the cable 1610 may include one or more (additional) ground conductors. The rib portions 1617 have rib heights H which are substantially the same, and which are substantially less than the insulated conductor outer dimension D. For example, the height H may be about one-half to one-fourth of D. The rib portions 1621 also have rib heights H' which are substantially the same, and which are substantially less than D, e.g., about one-half to one-fourth of D. The reduced rib heights produce conductive gaps between the tops of the rib portions 1617 and the tops of the rib portions 1621, but the gaps are filled or at least partially filled by the additional conductive members 1628.

Figure 17:
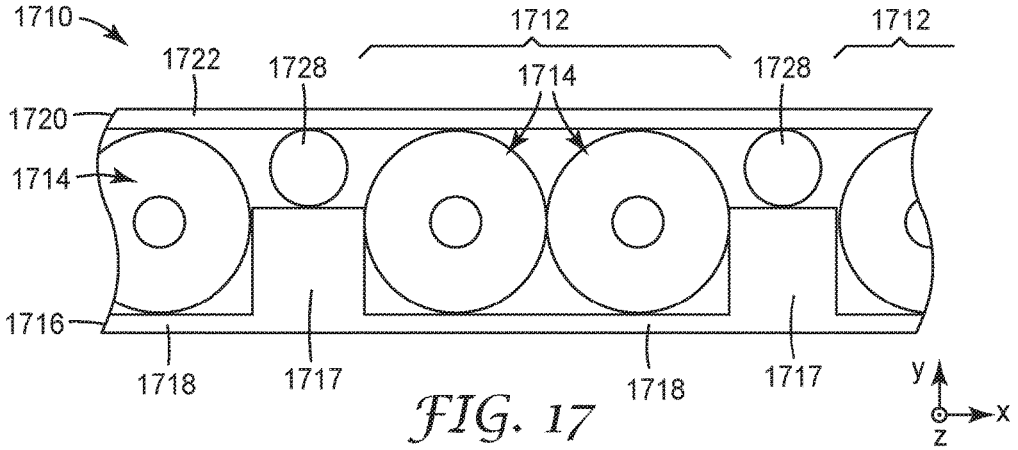

FIG. 17 shows a portion of another shielded electrical ribbon cable 1710 having a ribbed construction. The cable 1710 may be the same as or similar to cable 1210 of FIG. 12, except that additional conductive members can be placed between the second shielding film and the rib portions of the first shielding film to reduce or eliminate the conductive gaps created between such films. The cable 1710 thus includes on opposite sides thereof a first shielding film 1716 and a second shielding film 1720, which individually and in combination carry insulated conductors 1714, the insulated conductors being organized into conductor sets 1712. The first shielding film 1716 has a variable thickness which defines thick rib portions 1717 and thin connecting portions 1718. The second shielding film 1720 has a substantially uniform thickness. Electrically conductive portions of the first and second shielding films, including rib portions of the first shielding film, partially surround each conductor set 1712 due to the presence of gaps between the tops of the rib portions 1717 and the second shielding film 1720. However, in cable 1710, additional conductive members 1728 are disposed within the gaps to partially or entirely eliminate the conductive gaps and provide a conductive path that is closed, or that surrounds or at least partially surrounds, each conductor set 1712 so that the conductor sets within the cable are effectively electrically shielded from each other. One, some, or all of the additional conductive members 1728 may be ground conductors, or they may be non-insulated wires other than ground conductors, for example. Whether or not any of the additional conductive members 1728 are ground conductors, the cable 1710 may include one or more (additional) ground conductors. The rib portions 1717 have rib heights H which are substantially the same, and which are substantially less than the insulated conductor outer dimension D. For example, the height H may be about one-half to three-fourths of D. The reduced rib height produces conductive gaps between the tops of the rib portions 1717 and the second shielding film 1720, but the gaps are filled or at least partially filled by the additional conductive members 1728.

In some cases, the opposed shielding films may both be substantially uniform in thickness, i.e., without any rib portions, but separate rib-like conductive features can be attached to one or both shielding films, or otherwise positioned between such shielding films, to provide a ribbon cable with a ribbed construction. Two such embodiments of a shielded electrical ribbon cable are shown in FIGS. 18 and 19.

Figure 18:
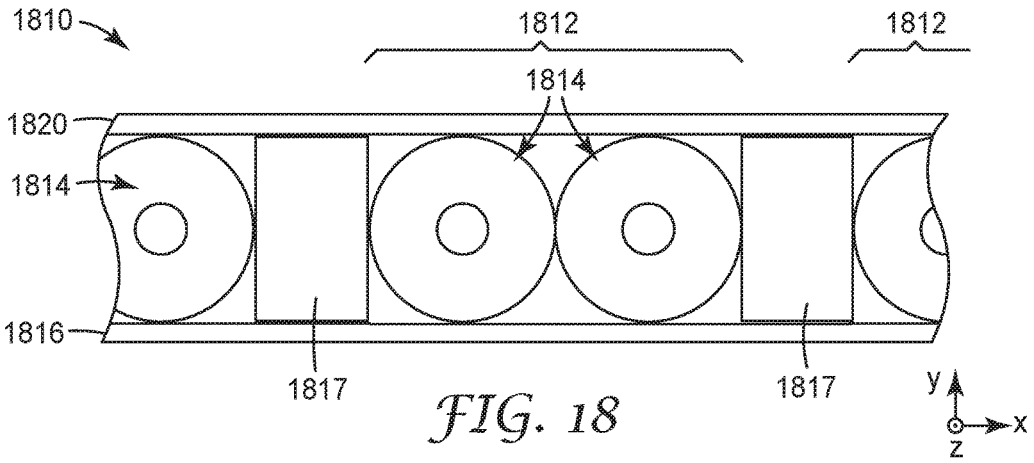

In FIG. 18, a portion of another shielded electrical ribbon cable 1810 having a ribbed construction is shown. The cable 1810 may be the same as or similar to cable 910 of FIG. 9, except that the ribbed first shielding film 916 is replaced with a shielding film of substantially uniform thickness, and separate conductive rib members are included between the opposed shielding films. Thus, the cable 1810 includes on opposite sides thereof a first shielding film 1816 and a second shielding film 1820, which individually and in combination carry insulated conductors 1814, the insulated conductors being organized into conductor sets 1812. The first shielding film 1816 has a substantially uniform thickness, and the second shielding film 1820 also has a substantially uniform thickness. Electrically conductive portions of the first and second shielding films partially surround each conductor set 1812; conductive rib members 1817 in combination with the shielding films provide a conductive path that is closed, or that surrounds or at least partially surrounds, each conductor set 1812 so that the conductor sets within the cable are effectively electrically shielded from each other. To promote high packing density, the conductive rib members 1817 are preferably relatively narrow along the width dimension (x-direction), e.g. as discussed in connection with the rib portions of FIG. 9. In addition to the conductive rib members, the cable 1810 may also include one or more ground conductors, not shown in FIG. 18. The rib members 1817 have rib heights which are substantially the same, and which are about equal to (and if desired, slightly greater than) the insulated conductor outer dimension D (shown elsewhere). In this case, conveniently, the first and second shielding films 1816, 1820 may remain substantially flat and still make electrical contact (through the rib members 1817) with each other to provide a closed or substantially closed cavity within which the insulated conductors 1814 of each conductor set 1812 may reside.

Figure 19:
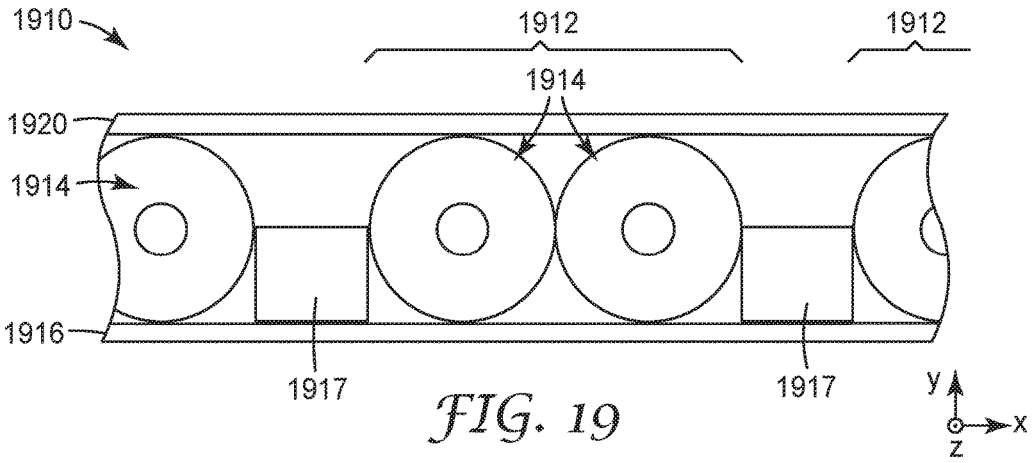

FIG. 19 shows a portion of another shielded electrical ribbon cable 1910 having a ribbed construction is shown. The cable 1910 may be the same as or similar to cable 1910 of FIG. 18, except that the conductive rib members of cable 1910 are substantially shorter such that gaps are created between the tops of the rib members and the upper shielding film. Thus, the cable 1910 includes on opposite sides thereof a first shielding film 1916 and a second shielding film 1920, which individually and in combination carry insulated conductors 1914, the insulated conductors being organized into conductor sets 1912. The first shielding film 1916 and the second shielding film 1920 both have a substantially uniform thickness. Electrically conductive portions of the first and second shielding films, in combination with separate conductive rib members 1917 which may be attached to film 1916, form a conductive path that partially surrounds each conductor set 1912 so that the conductor sets within the cable are effectively electrically shielded from each other. The cable 1910 may also include one or more ground conductors, not shown in FIG. 19. The rib members 1917 have rib heights which are substantially the same, and which are substantially less than the insulated conductor outer dimension D (shown elsewhere). For example, the height may be about half of D, e.g., in a range from 0.4*D to 0.6*D. The reduced rib height produces a conductive gap (i.e., an absence of electrically conductive material) between the tops of the rib members 1917 and the second shielding film 1920. In spite of the gaps, the first and second shielding films 1916, 1920, in combination with the rib members 1917, may provide enough conductive shielding around the conductor sets 1912 to provide adequate electrical isolation between such sets.

Figure 20:
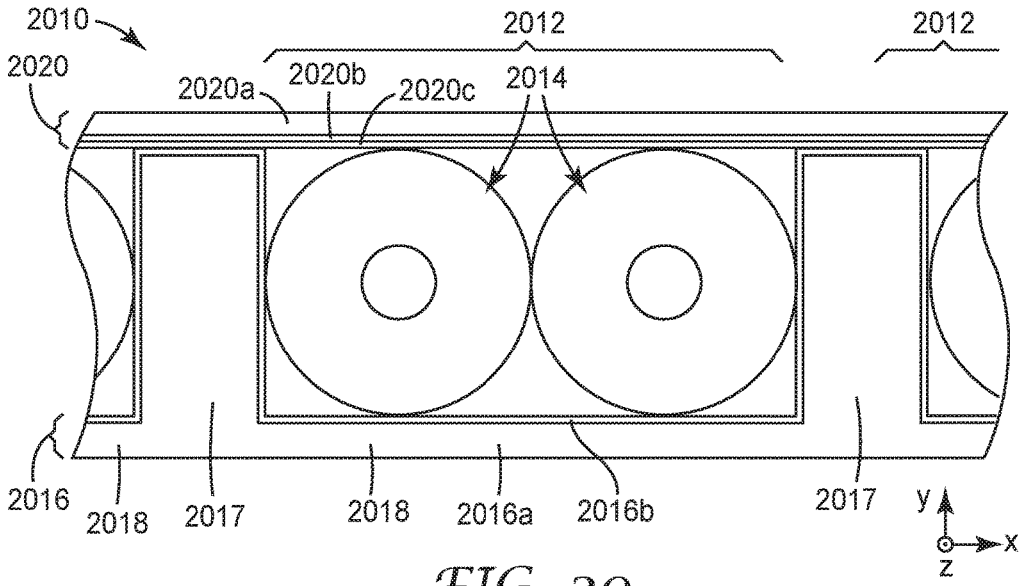
FIG. 20 is a front cross-sectional schematic view of a portion of an exemplary ribbed electrical ribbon cable, this view being enlarged to show design detail wherein the shielding films each have a metallization layer disposed on a base layer.
Figure 21:
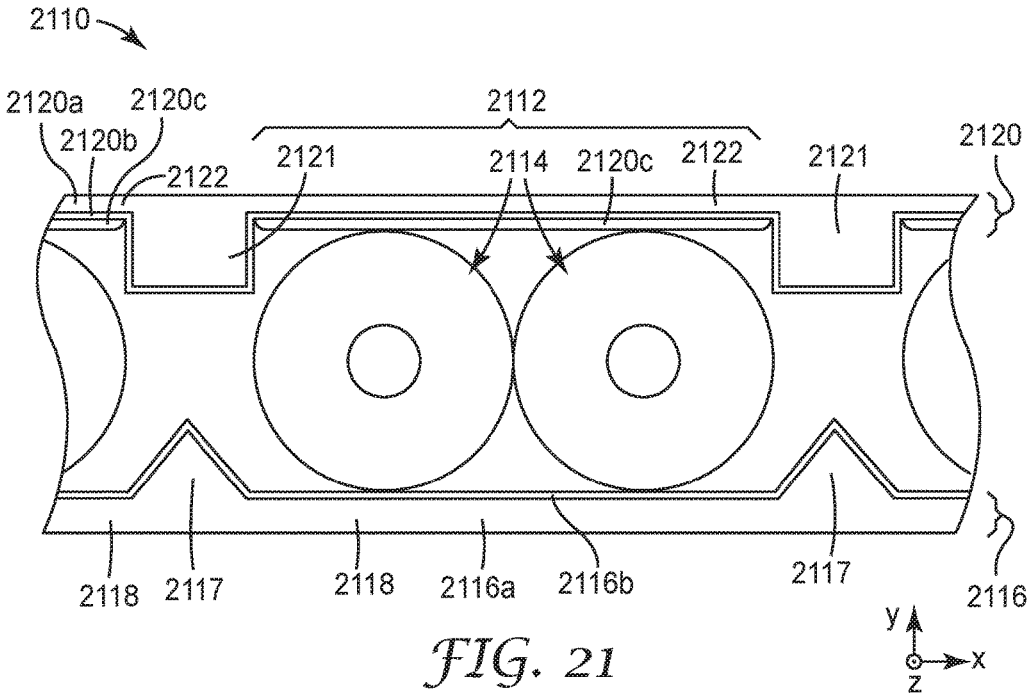
FIGS. 21 and 22 are front cross-sectional schematic views, enlarged to show detail as in FIG. 20, of portions of additional exemplary ribbed electrical ribbon cables.
Figure 22:
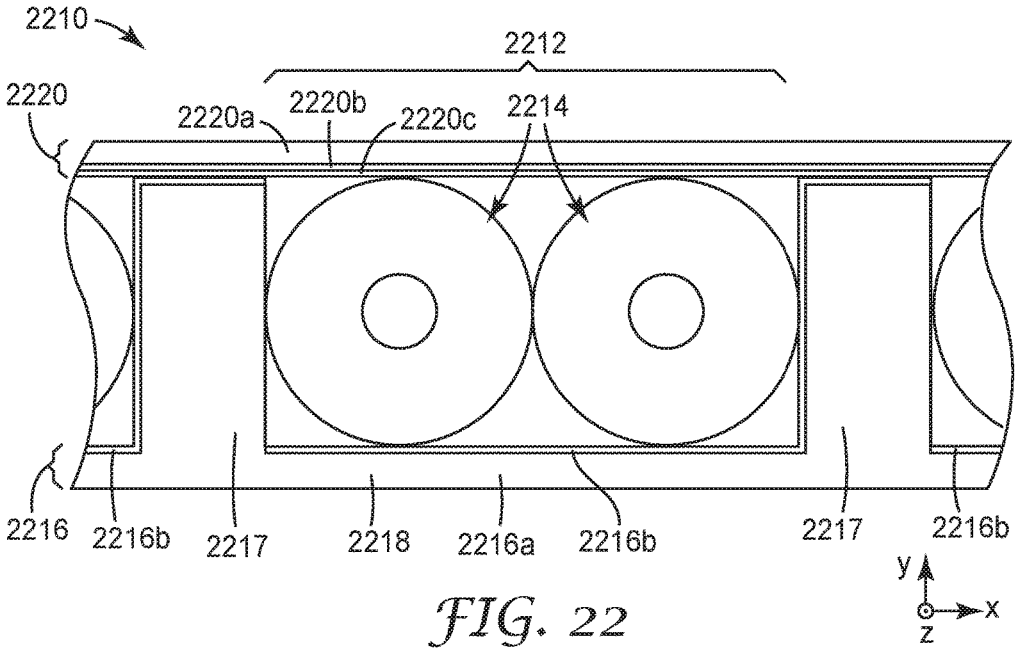

As mentioned above, few details of construction are shown in the simplified schematic views of FIGS. 9 through 19. Additional details of construction are therefore provided in connection with further illustrative embodiments as depicted in FIGS. 20, 21, and 22. The reader will understand that the principles and features discussed in connection with these further illustrative embodiments are equally applicable to any of the other embodiments described herein (and vice versa), including those discussed in connection with any of FIGS. 1 through 19. For clarity, the embodiments of FIGS. 20 through 22 are shown in the context of Cartesian coordinate systems that are consistent with that of FIG. 1.

FIG. 20 shows a portion of a shielded electrical ribbon cable 2010 having a ribbed construction. The cable 2010 includes insulated conductors 2014 organized into a plurality of conductor sets 2012, the conductor sets 2012 being spaced apart from each other along all or a portion of a width (x-direction) of the cable 2010, the conductor sets (and their respective individual insulated conductors) also each extending along a length (z-direction) of the cable 2010. As shown, at least one of the conductor sets 2012 may include two insulated conductors 2014, but other numbers of insulated conductors can also be used for any or all of the conductor sets 2012.

A first shielding film 2016 and a second shielding film 2020 are disposed on opposite sides of the cable 2010. These shielding films, individually and in combination, serve to carry the insulated conductors 2014 such that the insulated conductors 2014 remain confined within the cable. The second shielding film 2020 has a substantially uniform thickness. The first shielding film 2016 has a variable thickness which defines thick rib portions 2017 and thin connecting portions 2018. The rib portions and connecting portions alternate along the width of the shielding film 2016, with a spacing tailored so that the conductor sets 2012 can fit between consecutive rib portions 2017, with one insulated conductor 2014 of a given conductor set disposed proximate one rib portion 2017 and, optionally, another insulated conductor of such conductor set disposed proximate a different rib portion 2017. A given insulated conductor 2014 may be in physical contact with the rib portion 2017 it is adjacent to. To promote high packing density, the rib portions are preferably designed to be relatively narrow along the width dimension (x-direction) of the cable, as discussed elsewhere herein. The rib portions 2017 are shown as having a substantially rectangular shape in transverse cross section. In alternative embodiments, the rib portions 2017 can have other shapes, e.g. any of those discussed in connection with FIGS. 3 through 5.

Electrically conductive portions of the first and second shielding films, including rib portions of the first shielding film, may form a closed conductive path, or may surround, or at least partially surround, each conductor set 2012 so that the conductor sets within the cable are effectively electrically shielded from each other, with respect to electrical signal crosstalk and interference. Electrically conductive portions of the shielding films 2016, 2020 may for example collectively encompass at least 75%, or at least 80, 85, or 90%, or even 95% or 100%, of the perimeter of any given conductor set 2012.

In some cases the first shielding film 2016 may be a single monolithic layer of conductive material, but in FIG. 20 it is shown as an electrically non-conductive (i.e., insulating) base layer 2016*a* to which is applied a thin conductive coating 2016*b* such as a metal. The base layer 2016*a* may be composed of, for example, a polymer material or other suitable material that can be readily molded or otherwise shaped to define the basic ribbed profile. Exemplary materials for the base layer include polymeric materials such as polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, epoxies, natural rubber, and synthetic rubber. Additives and/or fillers may also be included to provide properties suitable for the intended application. Applied to one side or surface of the base layer 2016*a* is a thin conductive coating 2016*b*. As shown, the coating 2016*b* may be provided continuously over substantially the entire exposed surface of the rib portions 2017 and the entire exposed surface of the connecting portions 2018. As such, the coating 2016*b* may extend in an unbroken fashion from one conductor set 2012 to another. Alternatively, the coating 2016*b* may be provided selectively over only a portion of the exposed surface of the rib portions 2017 and/or of the connecting portions 2018. The coating 2016*b* may be or comprise a metallization layer comprising e.g. one or more of aluminum, nickel, silver, copper, gold, or other metals, or alloys thereof.

The second shielding film 2020 may also be a single monolithic layer of conductive material. However, in FIG. 20 it is shown as an electrically non-conductive (i.e., insulating) base layer 2020*a*, to which is applied a thin conductive coating 2020*b* and an adhesive layer 2020*c*. The base layer 2020*a* may be composed of any suitable material, for example, any of the polymer materials discussed in connection with layer 2016*a*. In this regard, for simplicity, the base layers 2016*a*, 2020*a* may be composed of the same material. In some cases however the base layers 2016*a*, 2020*a* may be composed of different materials. Applied to one side or surface of the base layer 2020*a* is a thin conductive coating 2020*b*. The coating 2020*b* may be provided continuously over substantially the entire exposed surface of the base layer 2020*a*. As such, the coating 2020*b* may extend in an unbroken fashion from one conductor set 2012 to another. Alternatively, the coating 2020*b* may be provided only over selected portions of the exposed surface of the base layer 2020*a*. The coating 2020*b* may be or comprise a metallization layer comprising e.g. any of the materials discussed in connection with coating 2016*b*. For simplicity, the coatings 2016*b*, 2020*b* may be composed of the same material, but in some cases they may be composed of different materials.

The adhesive layer 2020*c*, which is applied to the conductive coating 2020*b* (and/or to any exposed portions of the base layer 2020*a* not covered by the conductive coating 2020*b*), may function to hold the two opposed shielding films 2016, 2020 together such that the insulated conductors are held in place or trapped between the shielding films. The layer 2020*c* may be provided continuously over substantially the entire conductive coating 2020*b*. As such, the layer 2020*c* may extend in an unbroken fashion from one conductor set 2012 to another. Alternatively, the layer 2020*c* may be provided only over selected portions of the conductive coating 2020*b* and/or selected portions of any exposed surface of the base layer 2020*a*. The adhesive layer 2020*c* may be or comprise any suitable adhesive, including pressure sensitive adhesives (PSAs) and hot melt adhesives or any thermoset or thermoplastic adhesive. Exemplary adhesive materials include polyolefins, epoxies, acrylates, polyurethanes, urethanes, and cyanoacrylates. The adhesive layer 2020*c* may also include filler materials, including for example conductive particles. The adhesive layer 2020*c* may in fact be electrically conductive such that the conductive coating 2020*b* can be omitted, whereby the adhesive layer 2020*c* may serve the dual function of both a conductive coating, suitable for shielding purposes, and an adhesive layer.

Figure 20A:
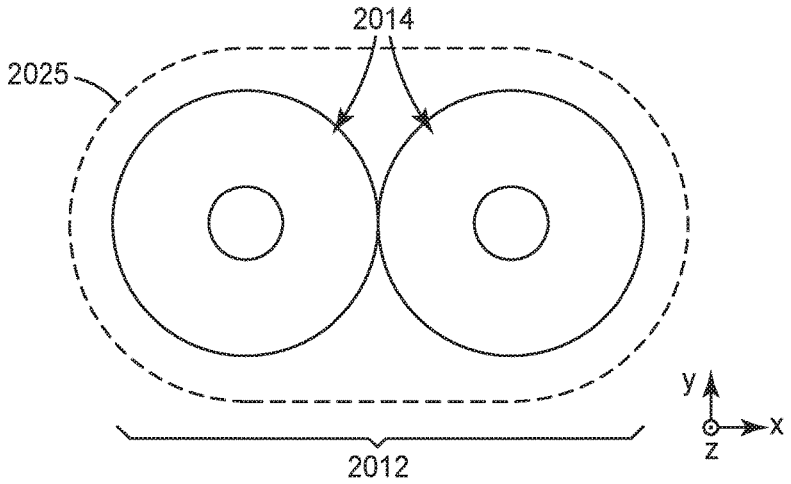
FIG. 20*a* is a front cross-sectional view similar to that of FIG. 20, but where electrical contact between the metallization layers of the opposed shielding films is shown schematically to form an electrical shield around the conductor set.

At the tops of the rib portions 2017, direct electrical contact can be made between the conductive coating 2016*b* and the conductive coating 2020*b*, e.g. if a portion of the conductive coating 2020*b* is not covered with the adhesive layer 2020*c* such that direct physical contact is made between the coatings 2016*b*, 2020*b*. Alternatively, indirect electrical contact can be made at the tops of the rib portions 2017 if the adhesive layer 2020*c* is sufficiently thin and/or sufficiently conductive to provide an effective DC coupling without actual physical contact between the coatings 2016*b*, 2020*b*. In both of these cases (i.e., embodiments having direct electrical contact and embodiments having indirect electrical contact), electrical contact, characterized by a low DC resistance, is established between the conductive coatings 2016*b*, 2020*b* such that they collectively form a closed conductive path that surrounds a given conductor set 2012. This is shown schematically in FIG. 20*a*. In that figure, a conductor set 2012 having two insulated conductors 2014 is surrounded in transverse cross section with a closed conductive path or envelope 2025. The conductive envelope 2025 may be made up of conductive portions of the rib portions 2017, a conductive portion of the connecting portion 2018, and a conductive portion of the second shielding film 2020.

In some cases, electrical connection is not made between the conductive coatings 2016*b*, 2020*b*, e.g. as a result of an electrically insulating adhesive layer 2020*c* disposed therebetween. In such cases, even though a completely closed conductive path is not achieved, the electrically conductive portions of the shielding films 2016, 2020 may nevertheless collectively encompass a substantial portion, e.g. at least 75%, or at least 80, 85, 90, or 95%, of the perimeter of the given conductor set, which may provide enough conductive shielding around the conductor set to provide adequate electrical isolation between conductor sets in the cable.

Unoccupied spaces or regions can be seen in FIG. 20, see e.g. the (unlabeled) spaces between a given insulated conductor 2014 and an adjacent insulated conductor 2014 in the same conductor set, and spaces between a given insulated conductor 2014 and a nearby surface of shielding film 2016 or shielding film 2020. These unoccupied spaces can if desired be filled with one or more components and/or materials. For example, a ground conductor can be introduced into such a space, as shown with the optional ground conductor 928 in FIG. 9. Alternatively or in addition, a bonding material such as an adhesive or other suitable material can fill one, some, or all such unoccupied spaces to hold the components of the ribbon cable together.

In FIG. 21, a portion of another shielded electrical ribbon cable 2110 is shown. The cable 2110 includes insulated conductors 2114 organized into a plurality of conductor sets 2112. A first shielding film 2116 and a second shielding film 2120 are disposed on opposite sides of the cable 2110, and serve to carry the insulated conductors 2114. In this embodiment, both the first and second shielding films have variable thicknesses that define alternating rib portions and connecting portions. The first shielding film 2116 has a variable thickness which defines thick rib portions 2117 and thin connecting portions 2118. The second shielding film 2120 also has a variable thickness which defines thick rib portions 2121 and thin connecting portions 2122. The rib portions 2117, 2121 are preferably designed to be relatively narrow along the width dimension for increased packing density. Rib portions 2117 are shown as having a substantially triangular shape in transverse cross section and rib portions 2121 are shown as having a substantially rectangular shape, but other shapes and combinations of shapes can also be used.

The rib portions 2117, 2121 are substantially shorter than rib portions 2017 of FIG. 20, such that conductive gaps are formed between the rib portions 2117, 2121. Nevertheless, electrically conductive portions of the first and second shielding films 2116, 2120, including the rib portions 2117, 2121 of the shielding films, may encompass at least 75, 80, 85, or 90% of the perimeter of the conductor set 2112.

The first shielding film 2116 comprises an electrically non-conductive (insulating) base layer 2116*a* to which is applied a thin conductive coating 2116*b* such as a metal. Details and characteristics of these components of the shielding film 2116 may be the same as or similar to the details and characteristics of the corresponding components of the shielding film 2016, described above.

The second shielding film 2120 also comprises an electrically non-conductive (insulating) base layer 2120*a*, to which is applied a thin conductive coating 2120*b* and an adhesive layer 2120*c*. Details and characteristics of these components of the shielding film 2120 may be the same as or similar to the details and characteristics of the corresponding components of the shielding film 2020, described above. However, unlike adhesive layer 2020*c*, the adhesive layer 2120*c* is shown to be selectively applied to the connecting portions 2122 of the film and not to the rib portions 2121 of the film.

In FIG. 22, a portion of another shielded electrical ribbon cable 2210 is shown. The cable 2210 includes insulated conductors 2214 organized into a plurality of conductor sets 2212. A first shielding film 2216 and a second shielding film 2220 are disposed on opposite sides of the cable 2210, and serve to carry the insulated conductors 2214. In this embodiment, the second film 2220 has a substantially uniform thickness, and the first film 2216 has a variable thicknesses that defines alternating rib portions 2217 and connecting portions 2218. The rib portions 2217 may have any or all of the features and characteristics discussed above in connection with rib portions 2017 of FIG. 20.

Similar to FIG. 20, electrically conductive portions of the first and second shielding films, including rib portions of the first shielding film, may form a closed conductive path, or may surround, or at least partially surround, each conductor set 2212 so that the conductor sets within the cable are effectively electrically shielded from each other.

The first shielding film 2216 comprises an electrically non-conductive (insulating) base layer 2216*a* to which is applied a thin conductive coating 2216*b* such as a metal. Details and characteristics of these components of the shielding film 2216 may be the same as or similar to the details and characteristics of the corresponding components of the shielding film 2016, described above. However, unlike conductive coating 2016*b*, the conductive coating 2216*b* is shown to be selectively applied to some surfaces but not other surfaces of the rib portions 2217. This results in a conductive envelope that lacks symmetry with respect to a central point or bisecting plane of the conductor set 2212, which may be considered disadvantageous in some applications for reasons discussed above.

The second shielding film 2220 also comprises an electrically non-conductive (insulating) base layer 2220*a*, to which is applied a thin conductive coating 2220*b* and an adhesive layer 2220*c*. Details and characteristics of these components of the shielding film 2120 may be the same as or similar to the details and characteristics of the corresponding components of the shielding film 2020, described above.

In the above figures, each insulated conductor is shown for convenience (in cross section) as a central circular-shaped conductor embedded within an outer annular-shaped circular insulator. See e.g. insulated constructors 114, 914, and 2014 shown in FIGS. 1, 9, and 20 respectively. Many insulated conductors have such a construction, however, insulated conductors having other constructions can also be used in any of the disclosed electrical cables. For example, the inner conductor can have a cross-sectional shape other than circular, and the outer insulator can also have a cross-sectional shape other than circular. Furthermore, in some cases the distinct outer insulators of adjacent insulated conductors can be replaced with a single monolithic insulator within which both inner conductors (or all inner conductors, if more than two adjacent insulated conductors are involved) are embedded. For example, the two adjacent insulated conductors 2012 shown in FIG. 20 can be modified by replacing the two distinct circular-shaped outer insulators with a single monolithic insulator within which both of the original inner conductors are embedded. The two inner conductors may have the same shapes, sizes, and relative positions as those shown in FIG. 20, and, if desired, the monolithic insulator may substantially fill the cavity (which in FIG. 20 is substantially rectangular-shaped) formed between the first and second shielding films.

Also in the above figures, the shielded electrical cables typically include two shielding films disposed on opposite sides of the cable such that. In some embodiments, however, the shielded electrical cable may contain only one shielding film, which is disposed on only one side of the cable. Advantages of including only a single shielding film in the shielded cable, compared to shielded cables having two shielding films, include a decrease in material cost and an increase in mechanical flexibility, manufacturability, and ease of stripping and termination. A single shielding film may provide an acceptable level of electromagnetic interference (EMI) isolation for a given application, and may reduce the proximity effect thereby decreasing signal attenuation.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Various modifications and alterations of this invention will be apparent to those skilled in the art without departing from the spirit and scope of this invention, and it should be understood that this invention is not limited to the illustrative embodiments set forth herein. For example, the reader should assume that features of one disclosed embodiment can also be applied to all other disclosed embodiments unless otherwise indicated. It should also be understood that all U.S. patents, patent application publications, and other patent and non-patent documents referred to herein are incorporated by reference, to the extent they do not contradict the foregoing disclosure.

The invention claimed is:

1. A shielded electrical cable, comprising:

a conductor set comprising adjacent first and second insulated conductors arranged substantially parallel to each other and extending along a length of the cable; and first and second electrically conductive shielding films disposed on opposite sides of the cable, each shielding film comprising a thinned connecting portion disposed between and connecting two thickened electrically conductive rib portions, the connecting and rib portions extending along the length of the cable, the rib portions of the first and second shielding films aligned with one another, aligned rib portions of the first and second shielding films spaced apart from each other along a thickness direction of the cable and defining a gap therebetween, the first and second insulated conductors disposed between the connecting portions and the aligned pairs of the rib portions of the first and second shielding films, wherein the first and second shielding films encompass at least 75% of the conductor set.

2. The shielded electrical cable of claim 1, wherein for at least one of the first and second shielding films, an adhesive layer is applied to the connecting portion, but not to tops of the two rib portions.

3. The shielded electrical cable of claim 1, wherein each shielding film comprises a polymeric base layer and a metallization layer disposed on the polymeric base layer.

4. The shielded electrical cable of claim 1, wherein the rib portions of the first and second shielding films have substantially uniform heights along the length of the cable.

5. The shielded electrical cable of claim 1, wherein the first and second shielding films encompass at least 80% of the conductor set.

6. The shielded electrical cable of claim 1, wherein the first and second shielding films encompass at least 85% of the conductor set.

* * * * *